US010133218B2

(12) United States Patent
Masuda et al.

(10) Patent No.: US 10,133,218 B2
(45) Date of Patent: Nov. 20, 2018

(54) PHASE CONTROL DEVICE, IMAGE FORMING APPARATUS, AND RECORDING MEDIUM

(71) Applicant: Konica Minolta, Inc., Tokyo (JP)

(72) Inventors: Junichi Masuda, Toyokawa (JP); Mikiyuki Aoki, Toyohashi (JP); Toru Kasamatsu, Toyokawa (JP); Masahiro Nonoyama, Toyokawa (JP); Akimasa Ishikawa, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/793,765

(22) Filed: Oct. 25, 2017

(65) Prior Publication Data

US 2018/0120742 A1 May 3, 2018

(30) Foreign Application Priority Data

Oct. 27, 2016 (JP) ..... 2016-210674

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01); *G03G 2215/00666* (2013.01)

(58) Field of Classification Search
CPC ..... G03G 15/20; G03G 15/2003; G03G 15/2014; G03G 15/2039; G03G 15/80; G03G 2215/00666; G05F 1/08; G05F 1/10; G05F 1/44; G05F 1/445; G05F 1/455
See application file for complete search history.

(56) References Cited

U.S. PATENT DOCUMENTS 8,295,728 B2 * 10/2012 Shin ..... G03G 15/2039 323/300
8,331,819 B2 * 12/2012 Fukuzawa ..... G03G 15/2039 399/69
2011/0274456 A1 * 11/2011 Higashi ..... G03G 15/2039 399/88

(Continued)

FOREIGN PATENT DOCUMENTS

JP H10-056772 A 2/1998
JP H11-161346 A 6/1999

(Continued)

*Primary Examiner* — Matthew Nguyen
(74) *Attorney, Agent, or Firm* — Baker & Hostetler LLP

(57) ABSTRACT

A phase control device includes: at least one switching element connected to an AC power source, the switching element being capable of: turning on and off at specified timings; delivering AC power to a load upon turn-on and cutting it off upon turn-off; and keeping an on-time from the start to the end of turn-on and an off-time from the start to the end of turn-off, the on-time and off-time being variable; a timing setting portion that sets a turn-on and turn-off timing for turning on and off the switching element; a judgment portion that judges whether or not the turn-on and turn-off timing are on at a phase within a first or second phase range; and a processor that starts turning on and off the switching element at the turn-on and turn-off timing, the processor being capable of adjusting the on-time and off-time depending on the judgment result.

15 Claims, 13 Drawing Sheets

(56) References Cited

U.S. PATENT DOCUMENTS

| | | | | |
|---|---|---|---|---|
| 2016/0018753 | A1* | 1/2016 | Sugimoto | G03G 15/043 347/118 |
| 2016/0062284 | A1* | 3/2016 | Song | G03G 15/2039 399/69 |
| 2017/0108806 | A1* | 4/2017 | Song | G03G 15/2053 |

FOREIGN PATENT DOCUMENTS

| | | | |
|---|---|---|---|
| JP | 2012-065530 | A | 3/2012 |
| JP | 2016-090700 | A | 5/2016 |

* cited by examiner

PHASE CONTROL DEVICE, IMAGE FORMING APPARATUS, AND RECORDING MEDIUM

The disclosure of Japanese Patent Application No. 2016-210674 filed on Oct. 27, 2016, including description, claims, drawings, and abstract, is incorporated herein by reference in its entirety.

BACKGROUND

Technological Field

The present invention relates to: a phase control device that delivers power to a load such as a heater from an AC power source while controlling the phase of the power; an image forming apparatus provided with this phase control device; and a recording medium.

Description of the Related Art

As a phase control method for turning on and driving a load such as a heater, using an AC power source, there has been the normal phase control method using a triac as a switching element for delivering power to a load from an AC power source and cutting it off. The normal phase control method allows turning on a triac under AC voltage of a specified phase, achieving accuracy in the control of power supply to a load such as a heater. In this method, however, when a triac is turned on under a high AC voltage of a 90 or 270-degree phase, for example, the voltage changes dramatically enough to cause much noise and time control cannot be performed. To solve this noise problem, a large noise filter for reducing noise is necessary, which brings up another problem.

As a phase control method for solving the noise problem without using a large noise filter, there has been the opposite phase control method using a metal oxide semiconductor field-effect transistor (MOSFET) or an insulated gate bipolar transistor (IGBT) as a switching element, which is heretofore known.

In contrast to the normal phase control method using a triac, the opposite phase control method is a method for turning on a MOSFET or an IGBT under AC voltage of an approximate 0 or 180-degree phase and turning it off under AC voltage of a specified phase. So, when a MOSFET or an IGBT is turned on, the voltage causes less noise than that caused in the normal phase control method.

Japanese Patent Application Publication No. H11-161346 suggests a phase control device that can be connected to an AC power source and a load with two lines and can be replaced with another phase control device having a triac without the need of reconfiguring the connection. The phase control device is allowed to perform both a normal phase control operation and an opposite phase control operation, using a unidirectional MOSFET or other power control element.

Japanese Patent Application Publication No. 2012-065530 suggests an inverter-run driving device including: a gate driver that controls the turn-on or turn-off of an IGBT and forcibly turns off the IGBT if a short-circuit or excess current is detected in the IGBT; a current buffer that amplifies IGBT turn-on or turn-off control current output by the gate driver; and a filter that determines a long turn-off time for the IGBT by delaying the output of IGBT forcible turn-off control current by the gate driver.

The phase control method using a MOSFET, for example, allows determining a long off-time for the MOSFET, in other words, allows slowing down the switching speed. So, even when the MOSFET is turned off under a high AC voltage, noise reduction can be implemented.

In these heretofore known techniques, however, while a long off-time is determined for the MOSFET, a long on-time is also determined for the MOSFET as well, which brings up another problem. That is, when a load such as a heater performs a cold boot under AC voltage of a 0 or 180-degree phase, much current, much noise, and large switching losses are invited.

The techniques described in Japanese Patent Application Publications No. H11-161346 and No. 2012-065530, however, do not bring a solution to the aforementioned problems.

SUMMARY

The present invention, which has been made in consideration of such a technical background as described above, provides a phase control device that is capable of reducing noise caused when a heater or other load is turned on and off; an image forming apparatus that is provided with this phase control device; and a recording medium.

To achieve at least one of the above-mentioned objects, a first aspect of the present invention relates to a phase control device including:

at least one switching element connected to an AC power source, the switching element being capable of:

turning on and off at specified timings;

delivering power to a load from the AC power source upon turn-on and breaking power supply to the load upon turn-off; and keeping an on-time from the start to the end of turn-on and an off-time from the start to the end of turn-off, the on-time and off-time being variable;

a timing setting portion that sets a turn-on timing for turning on the switching element and a turn-off timing for turning off the switching element;

a judgment portion that judges whether or not the turn-on and turn-off timing set by the timing setting portion are on at a phase within a first phase range or a second phase range, the first phase range representing a 0-degree phase and approximate 0-degree phases of AC voltage input by the AC power source, the second phase range representing a 180-degree phase and approximate 180-degree phases of AC voltage input by the AC power source; and a processor that starts turning on and off the switching element at the turn-on and turn-off timing set by the timing setting portion, the processor being capable of adjusting the on-time and off-time for the switching element depending on the judgment result obtained by the judgment portion, wherein, if the judgment portion judges that the turn-on and turn-off timing are on at a phase within the first phase range or the second phase range, the processor makes the on-time and off-time shorter than those obtained if the judgment portion judges that the turn-on and turn-off timing are on at a phase not within the first phase range or the second phase range.

To achieve at least one of the above-mentioned objects, a second aspect of the present invention relates to a non-transitory computer-readable recording medium storing a phase control program for a computer of a phase control device, the phase control device including at least one switching element connected to an AC power source, the switching element being capable of:

turning on and off at specified timings;

delivering power to a load from the AC power source upon turn-on and breaking power supply to the load upon turn-off; and keeping an on-time from the start to the end of turn-on and an off-time from the start to the end of turn-off, the on-time and off-time being variable;

the phase control program allowing the computer of the phase control device to execute:

setting a turn-on timing for turning on the switching element and a turn-off timing for turning off the switching element;

judging whether or not the turn-on and turn-off timing are on at a phase within a first phase range or a second phase range, the first phase range representing a 0-degree phase and approximate 0-degree phases of AC voltage input by the AC power source, the second phase range representing a 180-degree phase and approximate 180-degree phases of AC voltage input by the AC power source; and starting turning on and off the switching element at the turn-on and turn-off timing set by the timing setting portion and adjusting the on-time and off-time for the switching element depending on the judgment result obtained, wherein, if the turn-on and turn-off timing are on at a phase within the first phase range or the second phase range, the on-time and off-time is made shorter than those obtained if the turn-on and turn-off timing are on at a phase not within the first phase range or the second phase range.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
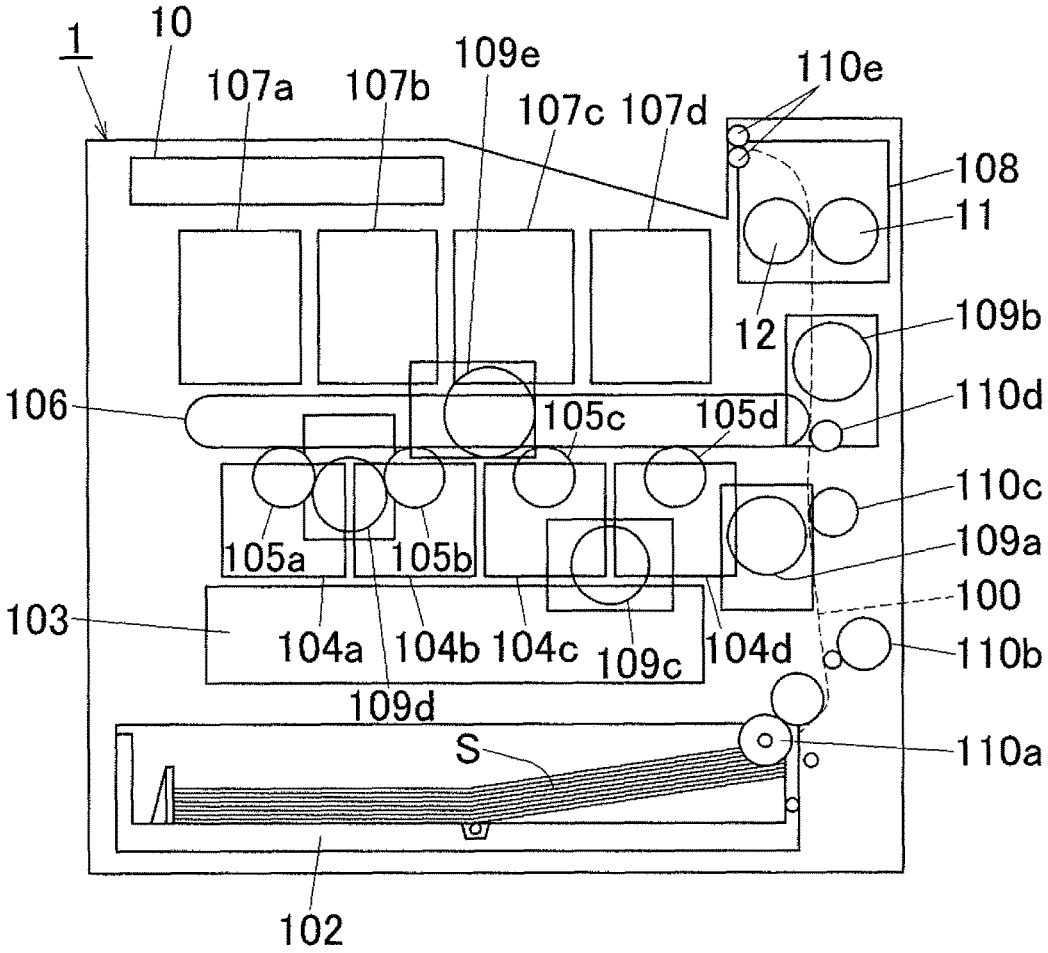
FIG. 1 is a schematic diagram illustrating a configuration of an image forming apparatus that is provided with a phase control device according to one embodiment of the present invention.

FIG. 1 is a schematic diagram illustrating a configuration of an image forming apparatus 1 that is provided with a phase control device according to one embodiment of the present invention. In this embodiment, a multi-function peripheral (MFP) i.e. multifunctional digital image forming apparatus having a printer function, facsimile function, scanner function, and other functions is employed as the image forming apparatus 1.

The image forming apparatus 1 is provided with a power-supply device 10 inside; the power-supply device 10 obtains DC power by converting power from an AC power source and delivers it to various drive parts and a control system of the image forming apparatus 1. The power-supply device 10 also delivers power to a heater of a fusing device 108 from the AC power source while controlling the phase of the power, as will be described later.

When the user gives instructions for printing to the image forming apparatus 1, a paper feed roller 110*a* takes sheets of paper S one by one as recording mediums loaded on a paper feed tray 102 and puts them on a paper conveyance path 100 one by one. Conveyance rollers 110*b* and 110*c* then convey the sheets of paper S one by one.

While the conveyance rollers 110*b* and 110*c* convey a sheet of paper S, charged CMYK photoconductors 105*a*, 105*b*, 105*c*, and 105*d* are exposed to light emitted by a laser unit 103 in accordance with image data. Developing units 104*a*, 104*b*, 104*c*, and 104*d*, containing color toner inside, develop the color toner to form color toner images onto the photoconductors 105*a*, 105*b*, 150*c*, and 105*d*, respectively. Upon impression of voltage, the photoconductors 105*a*, 105*b*, 105*c*, and 105*d* transfer the toner images of four colors, Yellow (Y), Magenta (M), Cyan (C), and Black (K), onto the transfer belt 160.

After that, a transfer roller 110*d* transfers the four-color toner images onto the sheet of paper S upon impression of voltage. While the sheet of paper S passes through the position between a pressure roller 11 and a fusing roller 12 heated by a heater, both of a fusing device 108, the toner images layered on the sheet of paper S are tightly fixed thereon. After that, a pair of paper output rollers 110*e* outputs the sheet of paper S, carrying the toner images fixed thereon, onto a paper output tray not shown in the figure.

The developing units 104*a*, 104*b*, 104*c*, and 104*d* consume color toner bit by bit in repeated image forming processes; and when running out of toner, the developing units 104*a*, 104*b*, 104*c*, and 104*d* receive color toner supplied from toner bottles 107*a*, 107*b*, 107*c*, and 107*d*, respectively.

There is a main motor 109*a* that is a rotating primary drive for conveying sheets of paper S from a paper feed process to a transfer process. The main motor 109*a* also drives the transfer belt 106 and the black photoconductor 105*d*. There is a fusing motor 109*b* that drives the fusing device 108.

There is a black developing motor 109*c* that drives the black developing unit 104*d*.

There is a color developing motor 109*d* that drives the developing units 104*a*, 104*b*, and 104*c* of Yellow (Y), Magenta (M), Cyan (C), and Black (K).

There is a color photoconductor motor 109*e* that drives the photoconductors 105*a*, 105*b*, and 105*c* of Yellow (Y), Magenta (M), Cyan (C), and Black (K).

Figure 2:
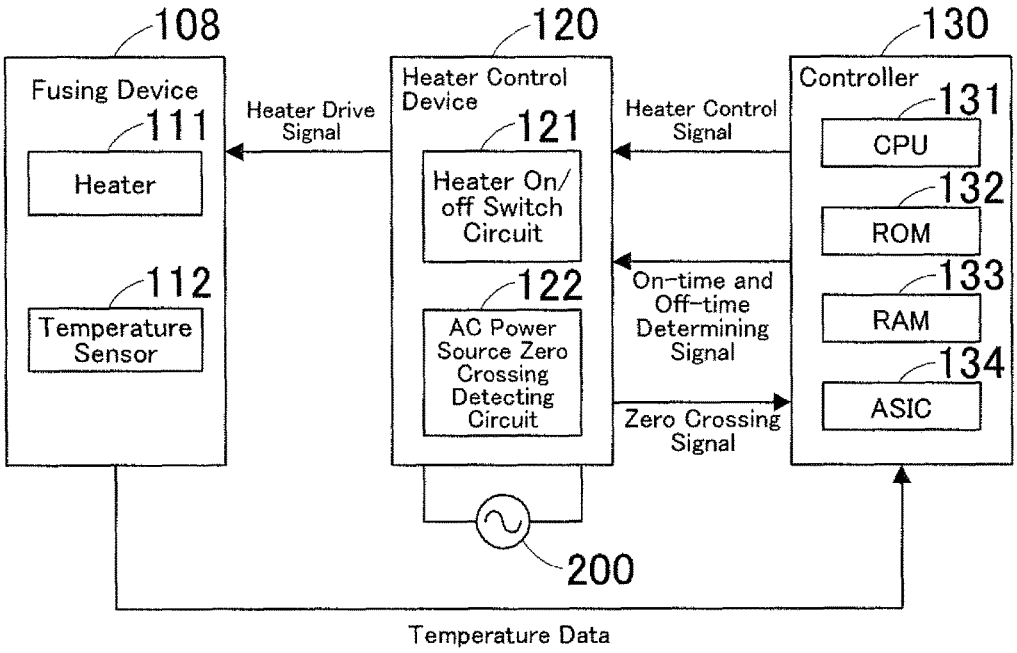
FIG. 2 is a block diagram illustrating a configuration of a phase control device that controls the driving of a heater of a fusing device.

FIG. 2 is a block diagram illustrating a configuration of a phase control device that controls the driving of the heater of the fusing device 108. The fusing device 108 is provided with a heater 111 for heating the fusing roller 12, as described above, and a temperature sensor 112 for detecting the temperature of the heat applied by the heater 111. The phase control device is essentially provided with a heater control device 120, a controller 130, and a switching element to be described below.

The heater control device 120 is provided with: a heater on/off switch circuit 121 that turns on and off the heater 111 by turning on and off the switching element; and an AC power source zero crossing detecting circuit 122 that detects a zero crossing point of voltage input by an AC power source 200. Alternatively, the heater on/off switch circuit 121 may be functionally achieved by the controller 130. In this embodiment, a commercial AC power source that supplies power at a frequency of 50 or 60 Hz is employed as the AC power source 200.

The controller 130 controls the entire image forming apparatus 1 including the heater 111. The controller 130 is essentially provided with a CPU 131 that conducts control operations; a ROM 132 that stores programs for the CPU 131 to perform operations; a RAM 133 that provides a workspace for the CPU 131 to execute a program; and an application-specific integrated circuit (ASIC) 134 that makes the CPU 131 to perform a specific operation.

This controller 130 receives temperature data from the temperature sensor 112 of the fusing device 108, and also receives zero crossing signals, indicating zero crossing points in the waveform of AC voltage input by the AC power source 200, from the AC power source zero crossing detecting circuit 122 of the heater control device 120. With reference to the temperature data and the zero crossing signals, the controller 130 determines a timing for turning on the switching element i.e. a timing for starting the driving of the heater 111 and a timing for turning off the switching element i.e. a timing for stopping the driving of the heater 111. The controller 130 then outputs heater control signals indicating these determined timings to the heater control device 120. The controller 130 also outputs on-time and off-time determining signals for the heater control device 120 to determine an on-time from the start to the end of turn-on and an off-time from the start to the end of turn-off for the switching element. Receiving these signals from the controller 130, the heater control device 120 controls power supply to the heater 111 by controlling the output of drive signals to the switching element 300.

Figure 3:
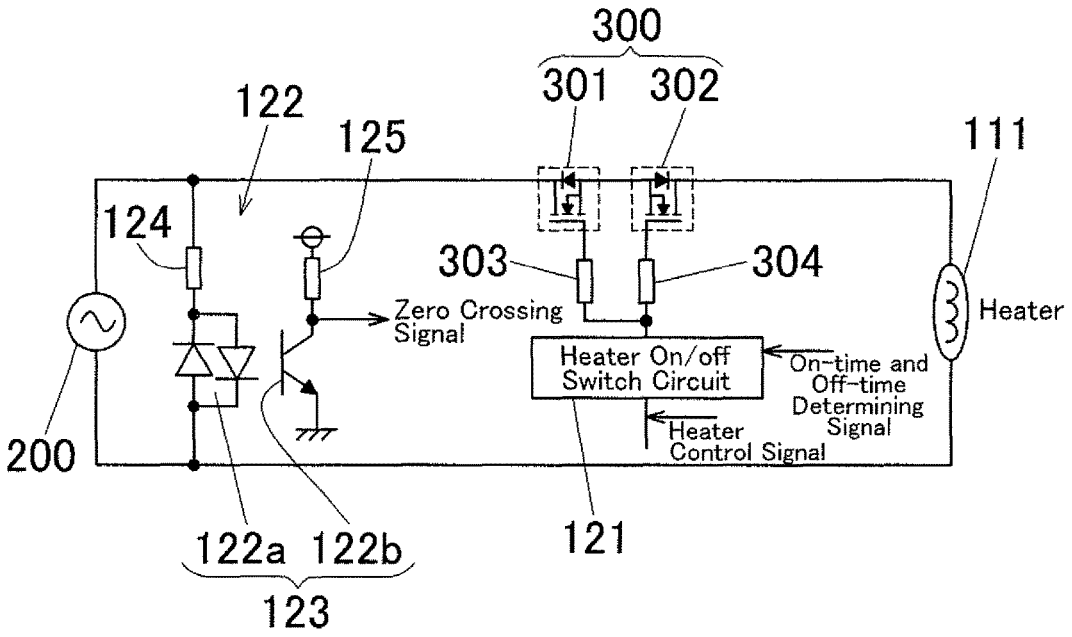
FIG. 3 is a circuit diagram illustrating an example of a phase control circuit.

FIG. 3 is a circuit diagram illustrating an example of a phase control circuit. In this phase control circuit, two switching elements, the switching elements 300 are connected between the AC power source 200 and the heater 111 as a load. These switching elements 300 can be turned on and off at specified timings. The switching elements 300 is constituted by an element capable of delivering power to the heater 111 from the AC power source 200 upon turn-on, breaking power supply to the heater 111 upon turn-off, and keeping a variable on-time and off-time, in other words, turning on and off at a variable switching speed.

In this example shown in FIG. 3, metal oxide semiconductor field-effect transistors (MOSFETs) 301 and 302 are used as the switching elements 300. Specifically, two MOSFETs, the MOSFETs 301 and 302 are connected in series with the AC power source 200 in a back-to-back-manner (back-to-back connection). The gates of the MOSFETs 301 and 302 are connected to the heater on/off switch circuit 121 by way of gate resistances 303 and 304, respectively. The heater on/off switch circuit 121 outputs a drive signal to the gates of the MOSFETs 301 and 302 to turn on the MOSFETs 301 and 302. While receiving no drive signal, the MOSFETs 301 and 302 are turned off.

With reference to the on-time and off-time determining signals received from the controller 130, the heater on/off switch circuit 121 regulates the gradient of the rising and falling edge of a drive signal for the MOSFETs 301 and 302. The heater on/off switch circuit 121 thus obtains the on-time and off-time determined for the MOSFETs 301 and 302.

The zero crossing detecting circuit 122 is connected in parallel with the AC power source 200. In this example, the zero crossing detecting circuit 122 is constituted by a photocoupler 123; the photocoupler 123 is constituted by photodiodes 122*a* connected in parallel in a back-to-back manner and a phototransistor 122*b*. The phototransistor 122*b* outputs a zero crossing signal every time source voltage goes inversely. In this figure, a resistance 124 for current control is connected between the AC power source 200 and the photodiode 122*a*, and a resistance 125 is connected between a direct-current power source not shown in the figure and the collector electrode of the phototransistor 122*b*.

Hereinafter, an operation of the phase control circuit shown in FIG. 3 will be described with reference to a waveform chart in FIG. 4.

Figure 4:
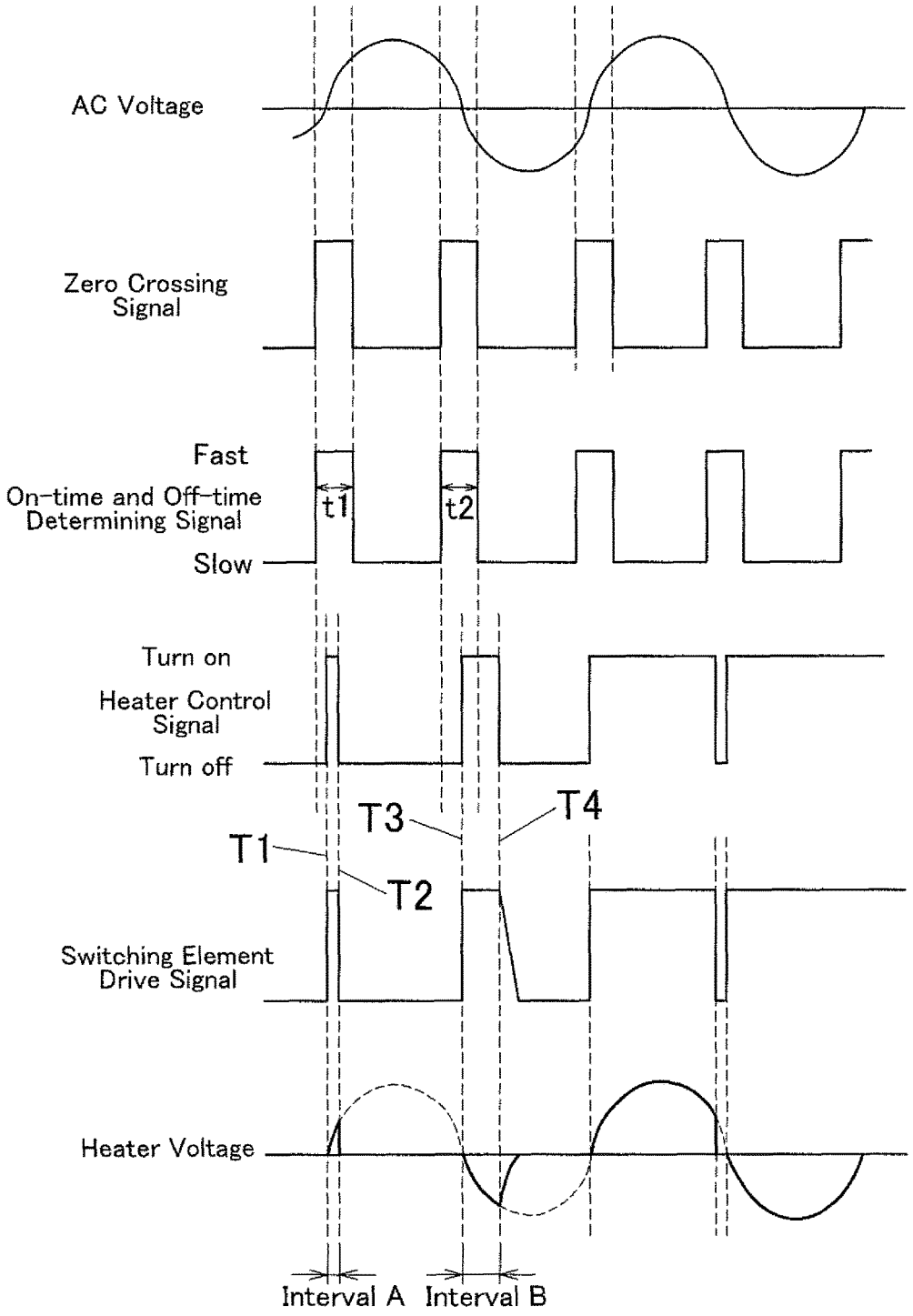
FIG. 4 shows waveform charts for explaining an operation of the phase control circuit shown in FIG. 3.

As illustrated in FIG. 4, detecting a zero crossing point in the waveform of AC voltage input by the AC power source 200, the zero crossing detecting circuit 122 inputs a zero crossing signal into the controller 130. Zero crossing signals constitute a pulsed signal waveform, in which the rising edge of a zero crossing signal occurs before a 0 and 180-degree phase of AC voltage that are zero crossing points and the falling edge of a zero crossing signal occurs after these zero crossing points.

The controller 130 generates on-time and off-time determining signals in accordance with these zero crossing signals. On-time and off-time determining signals constitute a pulsed signal waveform, in which a pulsed signal is high ("Fast" in FIG. 4) at a phase within a first phase range representing a 0-degree phase and approximate 0-degree phases and at a phase within a second phase range representing a 180-degree phase and approximate 180-degree phases, and a pulsed signal is low ("Slow" in FIG. 4) at a phase not within the first or second phase range. The first phase range and the second phase range are determined in advance. The phase angle in the first phase range (pulse length t1) and the phase angle in the second phase range (pulse length t2) may be the same or may be different from each other. For example, the first phase range may represent 348 to 12-degree phases and the second phase range may represent 168 to 192-degree phases. These phase ranges do not exceed the range of the inhibit voltage for a common triac, 30V (with an effective AC source voltage of 100V).

If the first and second phase range coincide with the on-periods of zero crossing signals, zero crossing signals may be used as on-time and off-time determining signals.

With reference to temperature data of the heater 111 and zero crossing signals, the controller 130 determines timings for starting and stopping the driving of the heater 111 i.e. timings for turning on and off the switching element 300. The controller 130 then outputs heater control signals indicating these determined timings to the heater control device 120. The rising edge of a heater control signal indicates the timing for turning on the switching element 300; and the falling edge of a heater control signal indicates the timing for turning off the switching element 300.

Receiving on-time and off-time determining signals and heater control signals, the heater on/off switch circuit 121 outputs drive signals to the switching element 300. Specifically, if the rising edge of a heater control signal, the timing for turning on the switching element 300, occurs when an on-time and off-time determining signal is high ("Fast" in the figure) i.e. at a phase within the first or second phase range, the heater on/off switch circuit 121 determines a short on-time to sharpen the rising edge of a drive signal; if the rising edge of a heater control signal occurs when an on-time and off-time determining signal is low ("Slow" in the figure) i.e. at a phase not within the first or second phase range, the heater on/off switch circuit 121 determines a long on-time to soften the rising edge of a drive signal. Similarly, if the falling edge of a heater control signal, the timing for turning off the switching element 300, occurs at a phase within the first or second phase range of an on-time and off-time determining signal, the heater on/off switch circuit 121 determines a short on-time to sharpen the falling edge of a drive signal; if the falling edge of a heater control signal occurs at a phase not within the first or second phase range of an on-time and off-time determining signal, the heater on/off switch circuit 121 determines a long on-time to soften the falling edge of a drive signal.

For example, as for the interval A in FIG. 4, the timing T1 for turning on the heater 111 (the rising edge of a heater control signal) is on when an on-time and off-time determining signal is high ("Fast" in the figure). In this case, the heater on/off switch circuit 121 determines a short on-time for the switching element 300 to turn it on immediately. The heater 111 is thus turned on immediately. During this interval, voltage whose waveform is shown in FIG. 4 is applied to the heater 111 in accordance with the curve of voltage input by the AC power source 200. Meanwhile, the timing T2 for turning off the heater 111 (the falling edge of a heater control signal) is on when an on-time and off-time determining signal is high ("Fast" in the figure). In this case, the heater on/off switch circuit 121 determines a short on-time for the switching element 300 to turn it off immediately. The heater 111 is thus turned off immediately. Furthermore, the switching element 300 is turned on and off under AC voltage of an approximate 0-degree phase that falls within the first phase range, which means the voltage level is too low to cause much noise.

As for the interval B in FIG. 4, the timing T3 for turning on the heater 111 (the rising edge of a heater control signal) is on when an on-time and off-time determining signal is high ("Fast" in the figure). In this case, the heater on/off switch circuit 121 determines a short on-time for the switching element 300 to turn it on immediately. The heater 111 is thus turned on immediately. During this interval, voltage is applied to the heater 111 in accordance with the curve of voltage input by the AC power source 200. Meanwhile, the timing T4 for turning off the heater 111 (the falling edge of a heater control signal) is on when an on-time and off-time determining signal is low ("Slow" in the figure). In this case, the heater on/off switch circuit 121 determines a long off-time for the switching element 300 to turn it off slowly. During this interval, the heater 111 is turned off slowly; although the voltage level is high, the voltage does not change dramatically enough to cause much noise.

Figure 12:
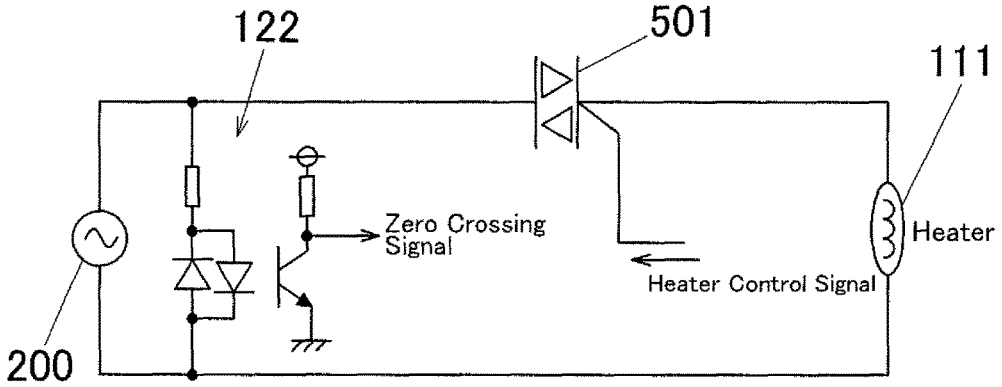
FIG. 12 is a circuit diagram illustrating a conventional phase control circuit having a triac as a switching element.
Figure 13:
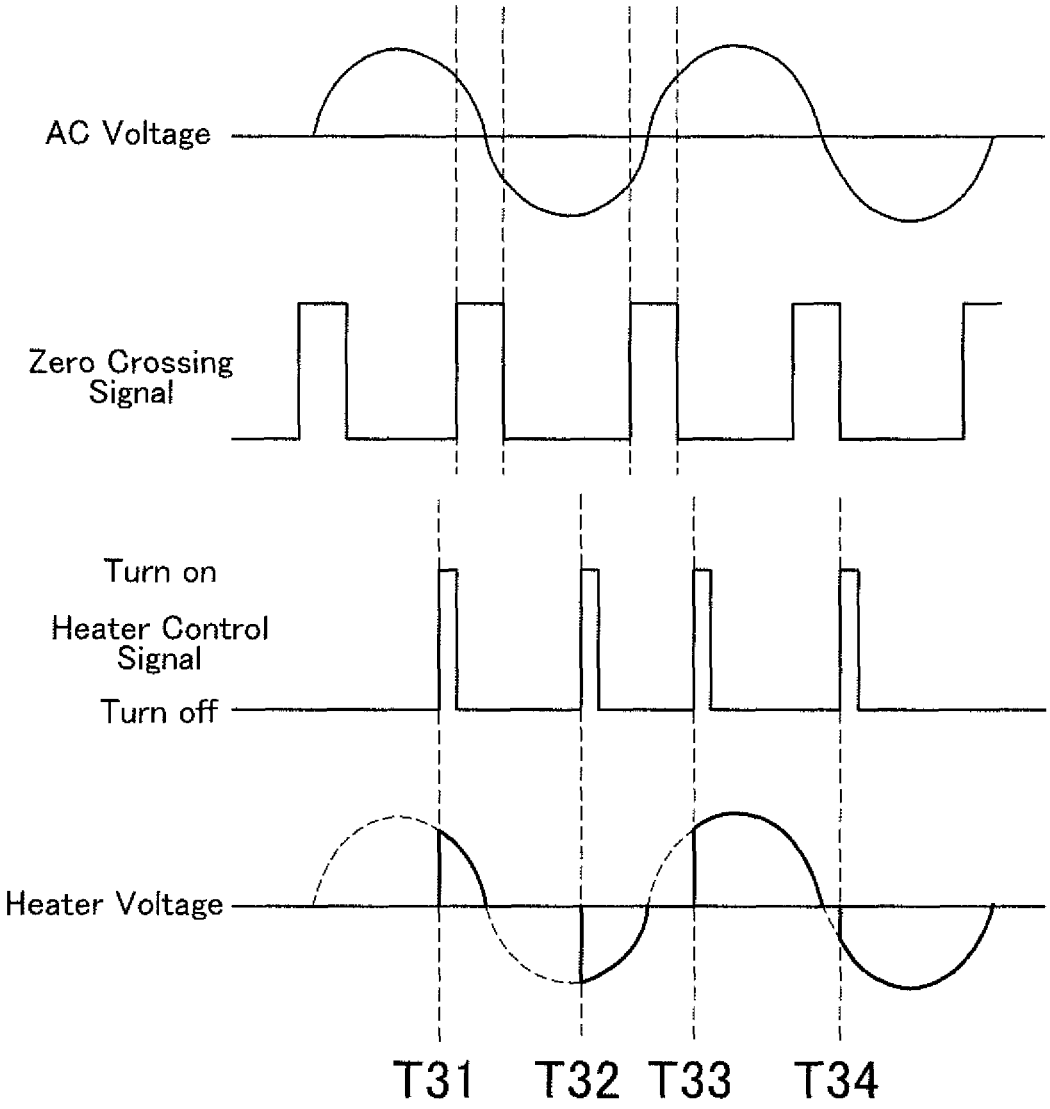
FIG. 13 shows waveform charts for explaining an operation of the phase control circuit shown in FIG. 12.

To compare to this circuit, a conventional phase control circuit shown in FIG. 12, having a triac 501 as a switching element, will be described below. Referring to the waveform charts shown in FIG. 13, the heater 111 is turned on at the timings T31, T32, T33, and T34 and the rising edges of heater control signals are sharp. This means, AC voltage is applied to the heater 111 immediately and the voltage changes dramatically enough to cause much noise.

Figure 14:
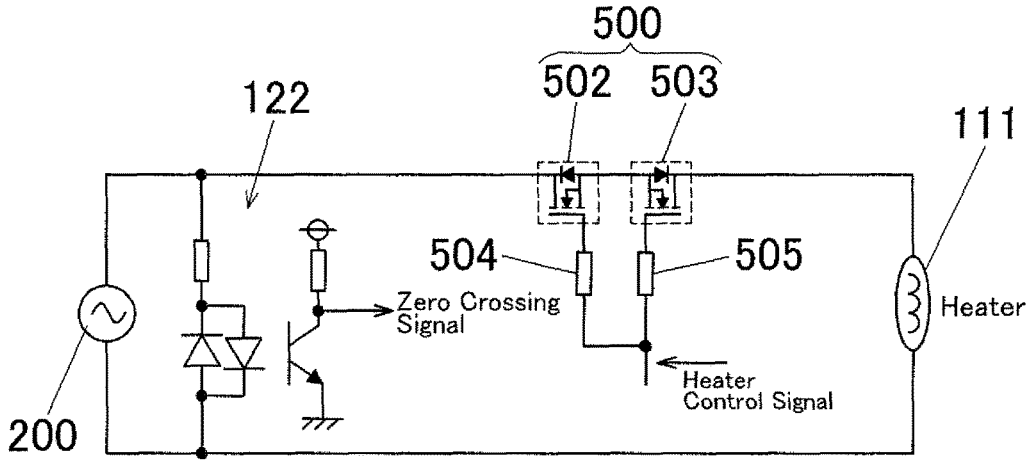
FIG. 14 is a circuit diagram illustrating a conventional phase control circuit having two MOSFETs as a switching element.
Figure 15:
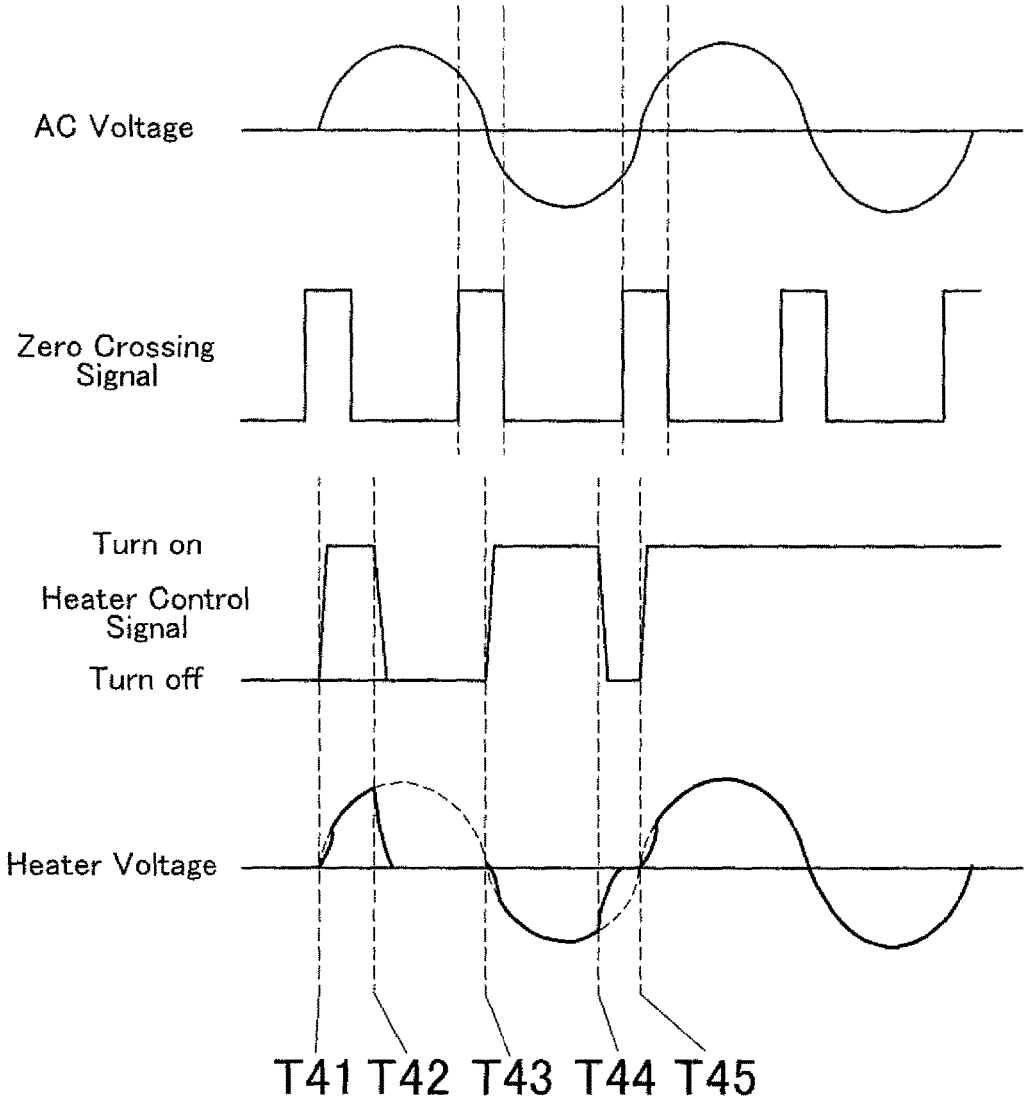
FIG. 15 shows waveform charts for explaining an operation of the phase control circuit shown in FIG. 14.

To further compare to this circuit, a conventional phase control circuit shown in FIG. 14, having two MOSFETs, the MOSFETs 502 and 503, as a switching element will be described below. Referring to the waveform charts shown in FIG. 15, the heater 111 is turned off at the timings T42 and T44 and the off-periods of heater control signals are long, in other words, the falling edges of heater control signals are soft. This means, the voltage does not change dramatically enough to cause much noise. Meanwhile, the heater 111 is turned on at the timings T41, T43, and T45 and the on-periods of heater control signals are long; however, a cold boot of the heater 111 will invite much current and much noise.

As described above, in this embodiment, if the rising and falling edge of a heater control signal, the timing for turning on and off the switching element 300, occur at a phase not within the first or second phase range, in other words, if these do not occur at an approximate 0 or 180-degree phase, a long on-time and off-time are determined for the switching element 300. So, even when the heater 111 is turned on under a high-level voltage of an approximate 90 or 270-degree phase, the voltage will not change dramatically enough to cause much noise. If the timing for turning on and off the switching element 300 occurs at a phase within the first or second phase range, in other words, at an approximate 0 or 180-degree phase of AC voltage, a short on-time and off-time are determined for the switching element 300. As a matter of course, noise reduction will be implemented when the heater 111 is turned off; but noise reduction also will be implemented even when the heater 111 performs a cold boot under a low-level voltage of an approximate 0 or 180-degree phase. This eliminates the necessity of a large noise filter for reducing noise.

As described above, in this embodiment, even when the heater 111 is turned on and off under a high-level voltage of an approximate 90 or 270-degree phase, a long on-time and off-time are determined. So, the voltage will not change dramatically enough to cause much noise. To achieve more reduction in noise, it is preferred that the timing for turning off the heater 111 be on at a phase not within a predetermined phase range including a 90-degree phase or another predetermined phase range including a 270-degree phase, which prevents the heater 111 from being turned off under a high AC voltage of an approximate 90 or 270-degree phase.

The phase control circuit shown in FIG. 3 can be used in the normal phase control method or the opposite phase control method, whichever is employed. In the opposite phase control method, the phase control circuit sets the timing for turning on the switching element 300 at a phase within the first or second phase range and sets the timing for turning off the switching element 300 at a specified phase of AC voltage. In the normal phase control method, the phase control circuit sets the timing for turning on the switching element 300 at a specified phase of AC voltage and sets the timing for turning off the switching element 300 at a phase within the first or second phase range.

Figure 5:
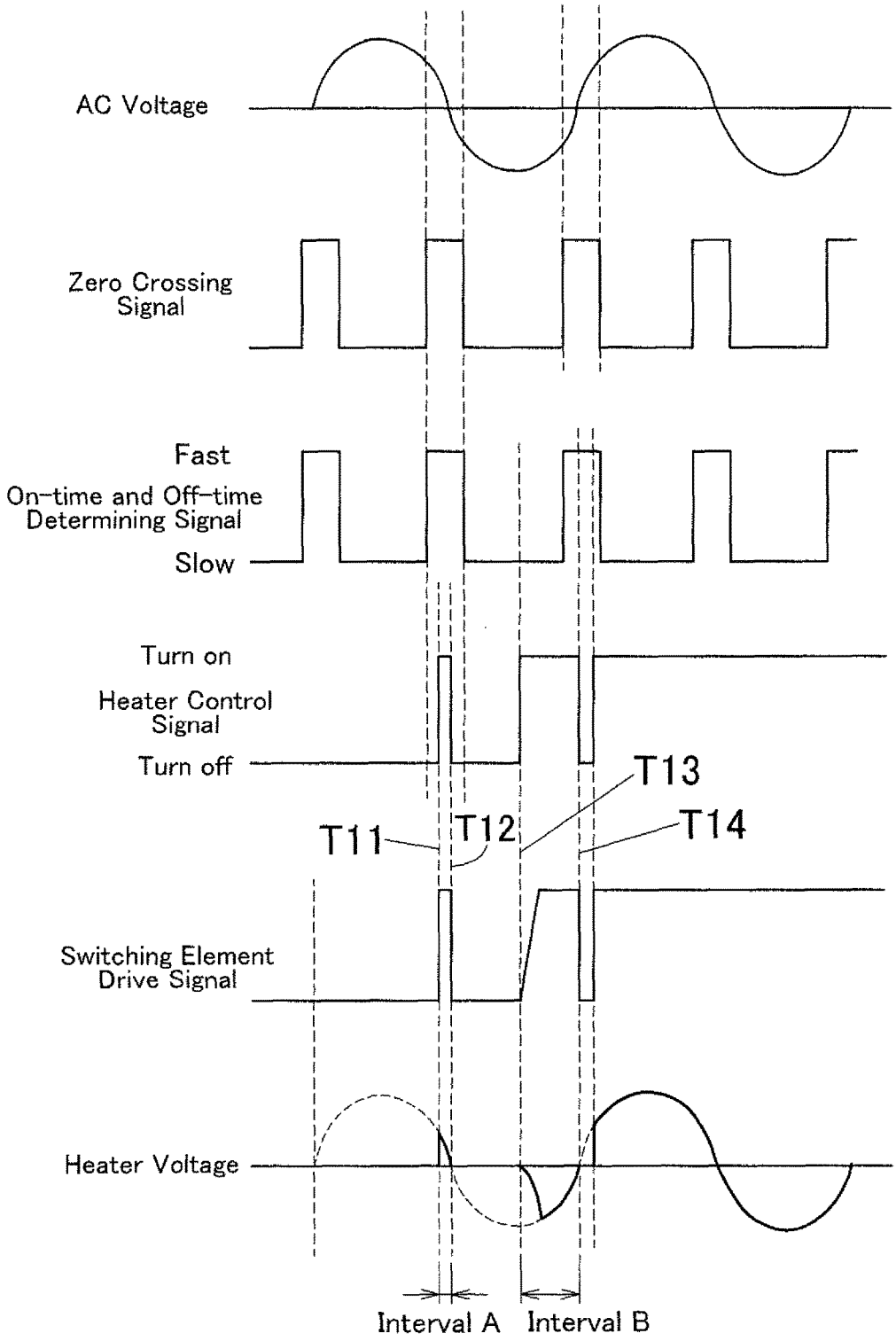
FIG. 5 shows waveform charts for explaining an operation of the phase control circuit shown in FIG. 3 when the normal phase control method is employed.

FIG. 5 shows waveform charts for explaining an operation of the phase control circuit shown in FIG. 3 when the normal phase control method is employed.

For example, as for the interval A in FIG. 5, the timing T11 for turning on the switching element 300, the rising edge of a heater control signal, is on before a 180-degree phase that is a zero crossing point; this is when the on-time and off-time determining signal is high ("Fast" in the figure). In this case, the heater on/off switch circuit 121 determines a short on-time for the switching element 300 to turn it on immediately. During this interval, the heater 111 is turned off immediately; although heater voltage is supplied immediately, the voltage level is too low to cause much noise. Meanwhile, the timing T12 for turning off the switching element 300, the falling edge of a heater control signal, is on at a 180-degree phase that is a zero crossing point or at an approximate 180-degree phase; this is when an on-time and off-time determining signal is high ("Fast" in the figure). In this case, the heater on/off switch circuit 121 determines a short on-time for the switching element 300 to turn it off immediately. The heater 111 is thus turned off immediately.

As for the interval B, the timing T13 for turning on the switching element 300 (the rising edge of a heater control signal) is on when an on-time and off-time determining signal is low ("Slow" in the figure). In this case, the heater on/off switch circuit 121 determines a long on-time for the switching element 300 to turn it on slowly. The heater 111 is thus turned on slowly. During this interval, although the voltage level is high, the voltage does not change dramatically enough to cause much noise.

Meanwhile, the timing T14 for turning off the switching element 300, the falling edge of a heater control signal, is on when an on-time and off-time determining signal is high ("Fast" in the figure). In this case, the heater on/off switch circuit 121 determines a short on-time for the switching element 300 to turn it off immediately. The heater 111 is thus turned off immediately.

As described above, in this embodiment, noise reduction is implemented even when the switching element 300 is turned on and off in the normal phase control method.

Figure 6:
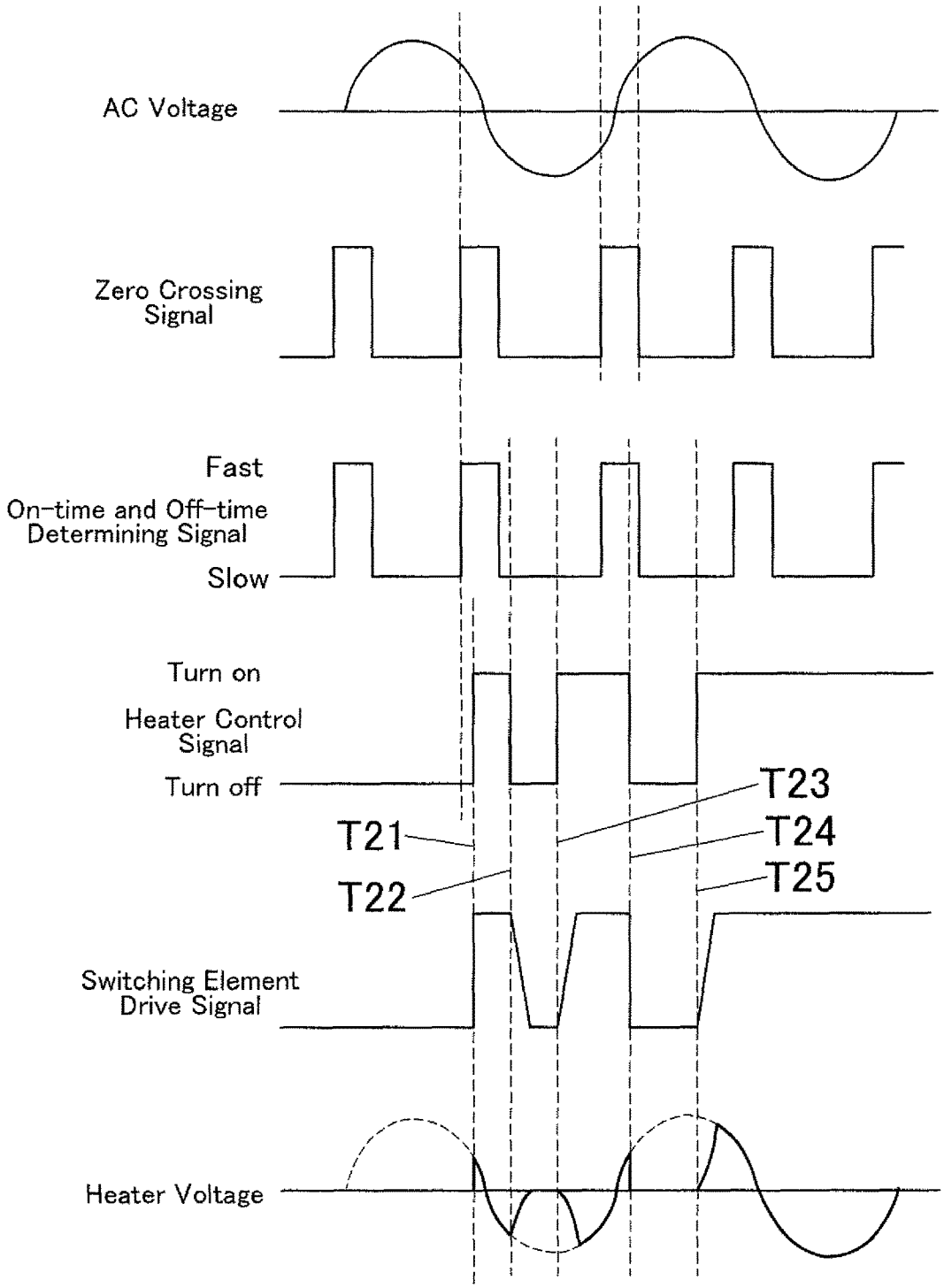
FIG. 6 shows waveform charts for explaining a non-zero crossing control operation of the phase control circuit shown in FIG. 3.

As in the examples shown in FIGS. 4 and 5, a zero crossing control operation that is turning on and off the switching element 300 when AC voltage reaches a zero crossing point is performed. Alternatively, a non-zero crossing control operation may be performed as to be described with reference to FIG. 6.

The non-zero crossing control operation is turning on and off the heater 111 by turning on and off the switching element 300 under AC voltage of a specified phase. In the example shown in FIG. 6, the switching element 300 is turned on at the timings T21, T23, and T25 and turned off at the timings T22 and T24. If it is when an on-time and off-time determining signal is high ("Fast" in the figure), the heater on/off switch circuit 121 determines a short on-time and off-time for the switching element 300 to turn it on and off immediately. If it is when an on-time and off-time determining signal is low ("Slow" in the figure), the heater on/off switch circuit 121 determines a long on-time and off-time for the switching element 300 to turn it on and off slowly. In this non-zero crossing control operation, noise reduction is implemented even when the switching element 300 is turned on and off with a high-level voltage and even when the heater 111 performs a cold boot under AC voltage of an approximate 0 or 180-degree phase.

In the above-described embodiment, for example, two MOSFETs, the MOSFETs 301 and 302, are used as the switching elements 300 and connected in series with the AC power source 200 in a back-to-back manner. It should be understood that the switching elements 300 are in no way limited to this example.

Figure 7:
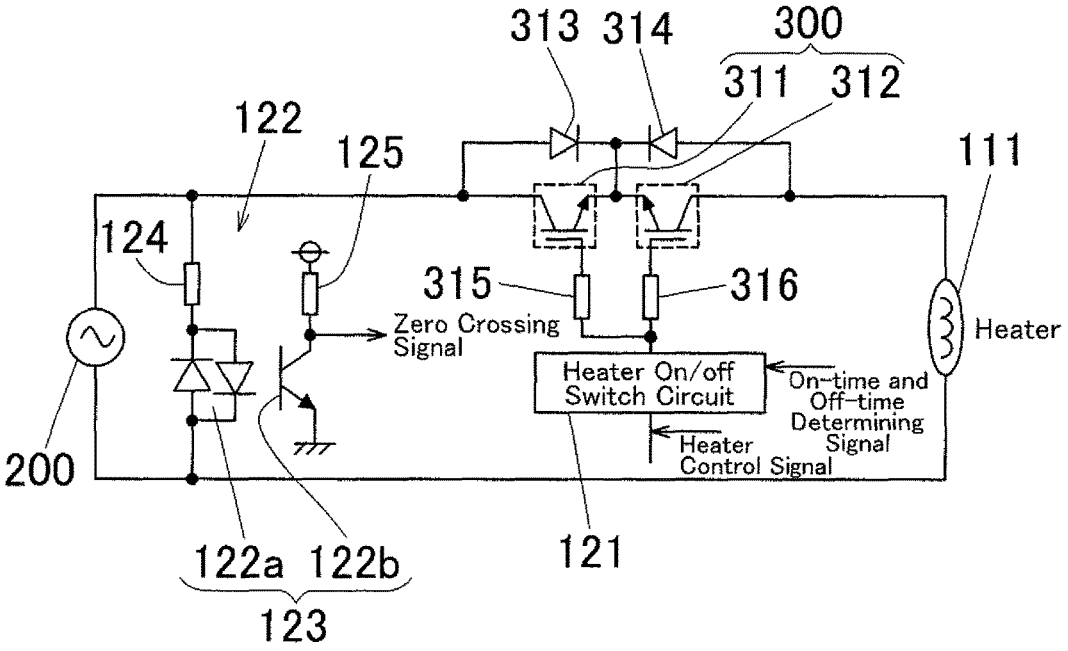
FIG. 7 is a circuit diagram illustrating an example of the phase control circuit with a switching element.

For another example, as illustrated in FIG. 7, two insulated gate bipolar transistors (IGBTs), the IGBTs 311 and 312, may be used as the switching elements 300; and the IGBTs 311 and 312 may be connected in parallel with the diodes 313 and 312, respectively, and connected in series with the AC power source 200 in a back-to-back manner. Similarly, in this case, the heater on/off switch circuit 121 outputs a drive signal to the gates of the IGBTs 311 and 312 by way of gate resistances 315 and 316 to turn on the IGBTs 311 and 312. While receiving no drive signal, the IGBTs 311 and 312 are turned off. The heater on/off switch circuit 121 is allowed to determine a short on-time and off-time by sharpening the rising and falling edge of a drive signal and to determine a long on-time and off-time by softening the rising and falling edge of a drive signal. If the rising or falling edge of a drive signal occurs when an on-time and off-time determining signal is high ("Fast" in the figure), the heater on/off switch circuit 121 determines a short on-time or off-time; if the rising or falling edge of a drive signal occurs when an on-time and off-time determining signal is low ("Slow" in the figure) the heater on/off switch circuit 121 determines a long on-time or off-time.

Figure 8:
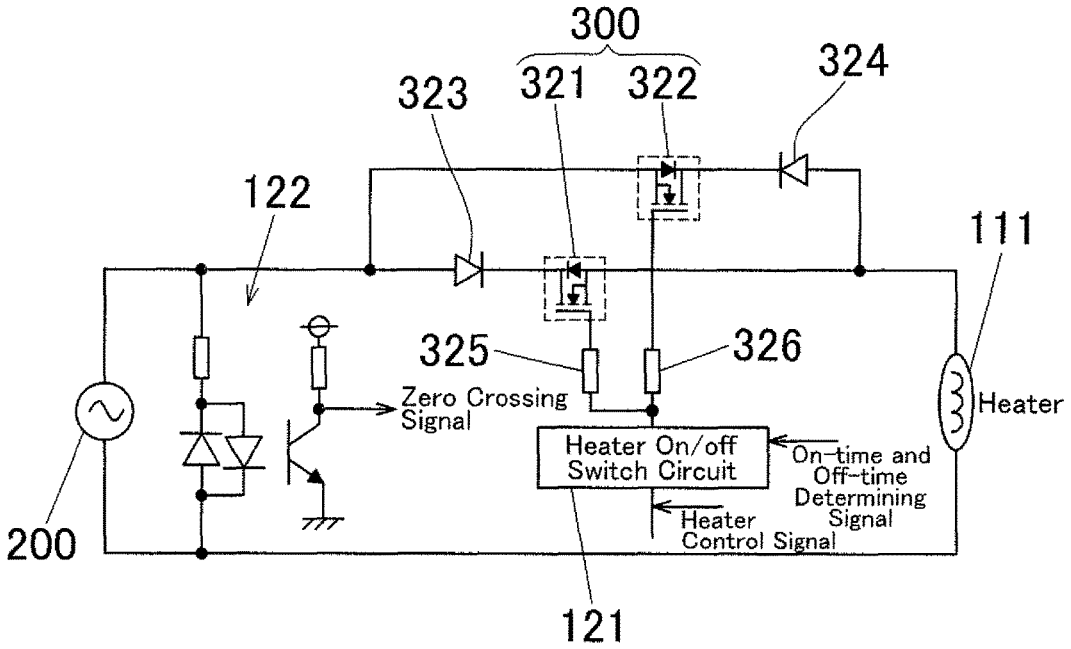
FIG. 8 is a circuit diagram illustrating another example of the phase control circuit with the switching element.

FIG. 8 is a circuit diagram illustrating another example of the phase control circuit with the switching element 300. In this example, two MOSFETs, MOSFETs 321 and 322, are used as the switching elements 300. The MOSFETs 321 and 322 are connected in series with diodes 323 and 324, respectively, and connected in series with the AC power source 200 while being connected in parallel with the AC power source 200 in a back-to-back manner. Similarly, in this case, the heater on/off switch circuit 121 outputs a drive signal to the gates of the MOSFETs 321 and 322 by way of gate resistances 325 and 326 to turn on the MOSFETs 321 and 322. While receiving no drive signal, the MOSFETs 321 and 322 are turned off. The heater on/off switch circuit 121 is allowed to determine a short on-time and off-time by sharpening the rising and falling edge of a drive signal and to determine a long on-time and off-time by softening the rising and falling edge of a drive signal. If the rising or falling edge of a drive signal occurs when an on-time and off-time determining signal is high ("Fast" in the figure), the heater on/off switch circuit 121 determines a short on-time or off-time; if the rising or falling edge of a drive signal occurs when an on-time and off-time determining signal is low ("Slow" in the figure) the heater on/off switch circuit 121 determines a long on-time or off-time.

Figure 9:
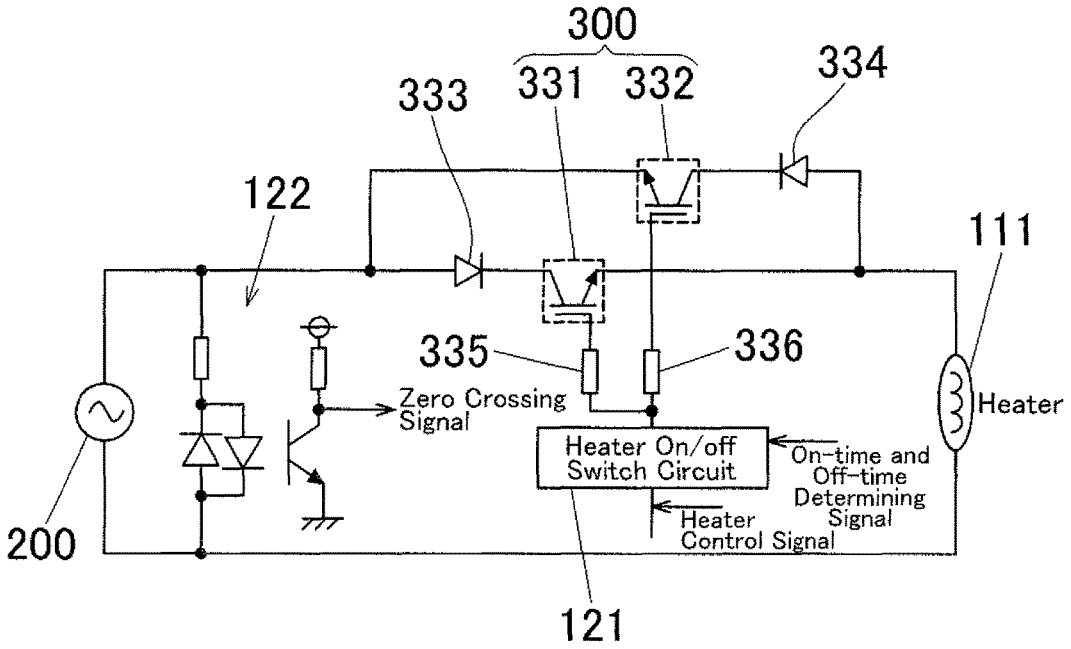
FIG. 9 is a circuit diagram illustrating yet another example of the phase control circuit with the switching element.

FIG. 9 is a circuit diagram illustrating yet another example of the phase control circuit with the switching element 300. In this example, two IGBTs, IGBTs 331 and 332, are used as the switching elements 300. The IGBTs 331 and 332 are connected in series with diodes 333 and 334, respectively, and connected in series with the AC power source 200 while being connected in parallel with the AC power source in a back-to-back manner. Similarly, in this case, the heater on/off switch circuit 121 outputs a drive signal to the gates of the IGBTs 331 and 332 by way of gate resistances 335 and 336 to turn on the IGBTs 331 and 332. While receiving no drive signal, the IGBTs 331 and 332 are turned off. The heater on/off switch circuit 121 is allowed to determine a short on-time and off-time by sharpening the rising and falling edge of a drive signal and to determine a long on-time and off-time by softening the rising and falling edge of a drive signal. If the rising or falling edge of a drive signal occurs when an on-time and off-time determining signal is high ("Fast" in the figure), the heater on/off switch circuit 121 determines a short on-time or off-time; if the rising or falling edge of a drive signal occurs when an on-time and off-time determining signal is low ("Slow" in the figure) the heater on/off switch circuit 121 determines a long on-time or off-time.

Although the method of determining an on-time and off-time for the switching element 300 is not limited to a specific one, the heater on/off switch circuit 121 can adjust the on-time and off-time by changing the gate resistance value. The switching element 300 has a parasitic capacitance C of its own; the heater on/off switch circuit 121 determines an on-time and off-time for the switching element 300 with reference to a time constant calculated from the parasitic capacitance C and the gate resistance value R. Specifically, the heater on/off switch circuit 121 changes the time constant C*R by changing the gate resistance value R, and thus adjusts the on-time and off-time by changing the time constant C*R.

Figure 10:
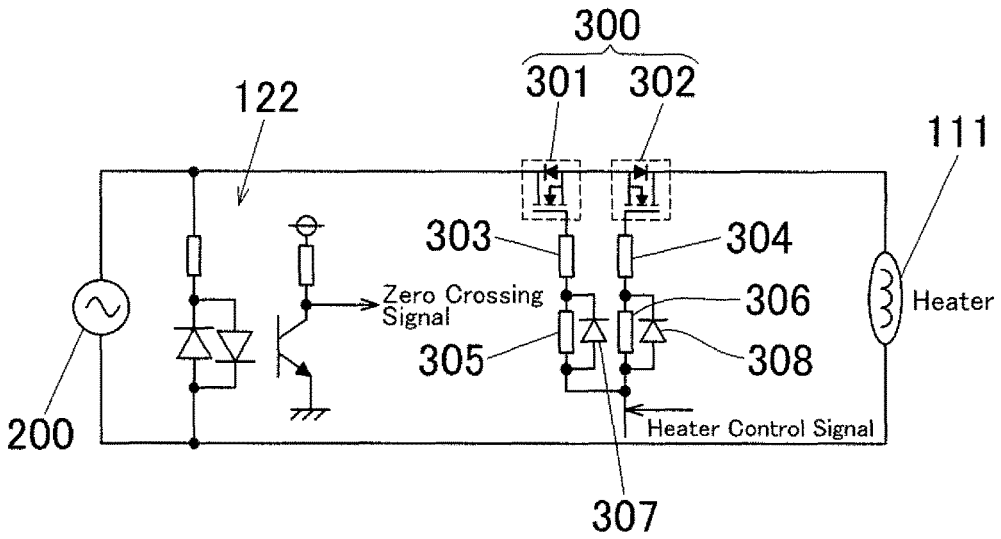
FIG. 10 is a circuit diagram illustrating an example of a phase control circuit that is capable of adjusting the on-time and off-time for the switching element by changing the gate resistance value such that the values to turn on and off are different, which is appropriate when the opposite phase control method is employed.

FIG. 10 is a circuit diagram illustrating an example of a phase control circuit that is capable of modifying the on-time and off-time for the switching element 300 by changing the gate resistance value such that the values to turn on and off are different, which is appropriate when the opposite phase control method is employed.

In this circuit similar to the phase control circuit shown in FIG. 3, two MOSFETs, the MOSFETs 301 and 302, are used as the switching elements 300 and connected in series with the AC power source 200 in a back-to-back manner. Identical components with those of the phase control circuit shown in FIG. 3 are given the same codes. In this phase control circuit, two gate resistances, the gate resistances 303 and 305, are connected in series with the gate of the MOSFET 301 and other two gate resistances, the gate resistances 304 and 306, are connected in series with the gate of the MOSFET 302. One of the two gate resistances, the gate resistance 305, and one of the other two gate resistances, the gate resistance 306, are connected in parallel with the diodes 307 and 308, respectively. The diodes 307 and 308 are arranged such that their cathode ends are directed to the gates of the MOSFETs 301 and 302.

With this configuration, the switching element 300 is turned on when a drive signal is high and turned off when a drive signal is low. When a drive signal is high to turn on, the gate resistances 305 and 306, which are connected in parallel with the diodes 307 and 308, respectively, do not affect the time constants because the diodes 307 and 308 cause a short-circuit. When a drive signal is low to turn off, the gate resistances 305 and 306, which are connected in parallel with the diodes 307 and 308, respectively, affect the time constants. As a result, a shorter on-time than an off-time is obtained. This configuration is most preferred in the opposite phase control method that is a method for turning on the switching element 300 under AC voltage of a 0 or 180-degree phase and turning it off under a high-level AC voltage because. It should be understood that the number of the gate resistances 303 to 306 is in no way limited to the example of FIG. 10; it is only necessary that the number bring time constants that satisfy the inequality: on-time≤off-time.

Figure 11:
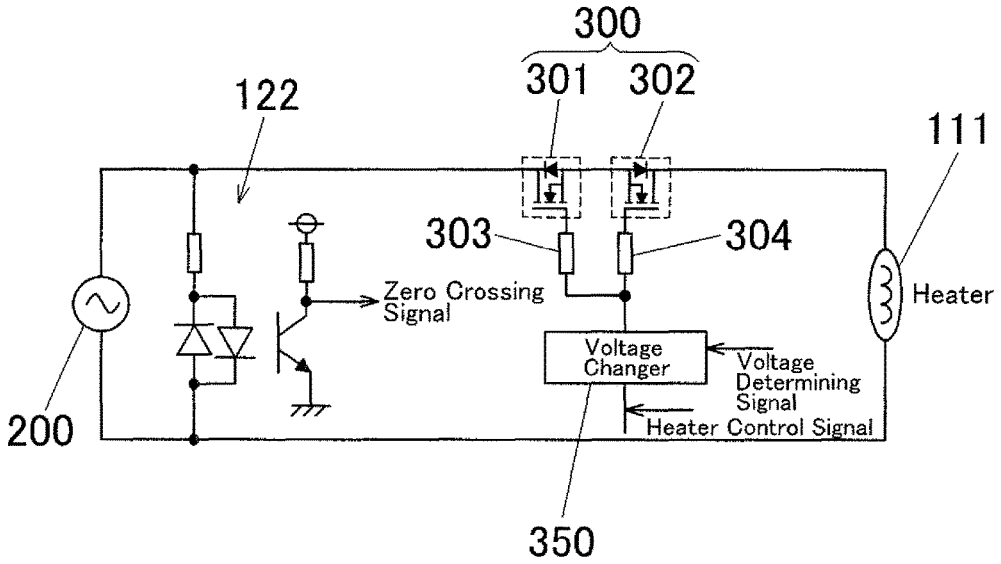
FIG. 11 is a circuit diagram illustrating another example of the phase control circuit that is capable of adjusting the on-time and off-time for the switching element.

FIG. 11 is a circuit diagram illustrating another example of the phase control circuit that is capable of adjusting the on-time and off-time for the switching element 300. In this phase control circuit, being further provided with a voltage changer 350, the heater on/off switch circuit 121 is capable of changing the voltage level of a drive signal to the switching element 300.

Time constants for an on-time and off-time are the same because these are both determined by the parasitic capacitance of the switching element 300 and the gate resistance. Meanwhile, a high drive voltage brings a short on-time and off-time and a low drive voltage brings a long on-time and off-time. In this embodiment, the heater on/off switch circuit 121 is capable of adjusting the on-time and off-time by stepping up the drive voltage within the first phase range and the second phase range and stepping down the drive voltage not within the first phase range or the second phase range. The heater on/off switch circuit 121 receives, instead of on-time and off-time determining signals, voltage determining signals constituting a waveform similar to that of on-time and off-time determining signals, from the controller 130. In accordance with the voltage determining signals, the voltage changer 350 changes the voltage level of drive signals.

While one embodiment of the present invention has been described in details herein it should be understood that the present invention is not limited to the foregoing embodiment. For example, in the examples of FIGS. 10 and 11, the MOSFETs 301 and 302 are used as the switching elements 300. Using IGBTs instead of the MOSFETs 301 and 302, the heater on/off switch circuit 121 can adjust the on-time and off-time similarly.

At the beginning of a phase control operation, the switching element 300 may be turned on under AC voltage whose phase angle is raised stepwise every half-wave such that the heater 111 is turned on under power being increased stepwise. Such a configuration is preferred because it allows successfully turning on the heater 111 while achieving more reduction in noise.

At the end of a phase control operation, the switching element 300 may be turned off under AC voltage whose phase angle is lowered stepwise every half-wave such that the heater 111 is turned off under power being reduced stepwise. Such a configuration is preferred because it allows turning off the heater 111 while achieving more reduction in noise.

In this embodiment, the heater 111 is described as a load used in the fusing device 108 of the image forming apparatus 1. Alternatively, such a load may be used in another device than the fusing device 108, may be another load than a heater, and may be one of various loads driven by a power-supply device, for example.

In the following paragraphs, some preferred embodiments of the invention will be described by way of example and not limitation. It should be understood based on this disclosure that various other modifications can be made by those in the art based on these illustrated embodiments.

What is claimed is:

1. A phase control device comprising:

at least one switching element connected to an AC power source, the switching element being capable of:

turning on and off at specified timings;

delivering power to a load from the AC power source upon turn-on and breaking power supply to the load upon turn-off; and keeping an on-time from the start to the end of turn-on and an off-time from the start to the end of turn-off, the on-time and off-time being variable;

a timing setting portion that sets a turn-on timing for turning on the switching element and a turn-off timing for turning off the switching element;

a judgment portion that judges whether or not the turn-on and turn-off timing set by the timing setting portion are on at a phase within a first phase range or a second phase range, the first phase range representing a 0-degree phase and approximate 0-degree phases of AC voltage input by the AC power source, the second phase range representing a 180-degree phase and approximate 180-degree phases of AC voltage input by the AC power source; and a processor that starts turning on and off the switching element at the turn-on and turn-off timing set by the timing setting portion, the processor being capable of adjusting the on-time and off-time for the switching element depending on the judgment result obtained by the judgment portion, wherein, if the judgment portion judges that the turn-on and turn-off timing are on at a phase within the first phase range or the second phase range, the processor makes the on-time and off-time shorter than those obtained if the judgment portion judges that the turn-on and turn-off timing are on at a phase not within the first phase range or the second phase range.

2. The phase control device according to claim 1, wherein the timing setting portion sets the turn-on timing at a phase within the first phase range or the second phase range and sets the turn-off timing at a specified phase of the AC voltage.

3. The phase control device according to claim 1, wherein the timing setting portion sets the turn-on timing at a specified phase of the AC voltage and sets the turn-off timing at a phase within the first phase range or the second phase range.

4. The phase control device according to claim 1, wherein the switching element is constituted by a MOSFET, the phase control device comprising two MOSFETs connected in series with the AC power source in a back-to-back manner.

5. The phase control device according to claim 1, wherein the switching element is constituted by an IGBT, the phase control device comprising two IGBTs connected in parallel with the respective diodes, the two IGBTs being connected in series with the AC power source in a back-to-back manner.

6. The phase control device according to claim 1, wherein the switching element is constituted by a MOSFET, the phase control device comprising two MOSFETs connected in series with their respective diodes, the two MOSFETs being connected in series with the AC power source while being connected in parallel with the AC power source in a back-to-back manner.

7. The phase control device according to claim 1, wherein the switching element is constituted by an IGBT, the phase control device comprising two IGBTs connected in series with their respective diodes, the two IGBTs being connected in series with the AC power source while being connected in parallel with the AC power source in a back-to-back manner.

8. The phase control device according to claim 1, further comprising a zero crossing detector that detects when the AC voltage reaches a 0 or 180-degree phase, wherein the timing setting portion sets the turn-on and turn-off timing in accordance with detection signals input by the zero crossing detector.

9. The phase control device according to claim 1, wherein the processor adjusts the on-time and off-time for the switching element by changing the value of a resistance, the resistance being connected to an input terminal for receiving a signal for turning on and off the switching element.

10. The phase control device according to claim 1, wherein the processor adjusts the on-time and off-time for the switching element by changing the voltage value at an input terminal for receiving a signal for turning on and off the switching element.

11. The phase control device according to claim 1, wherein the timing setting portion sets the turn-off timing at a phase not within a first predetermined phase range including a 90-degree phase or a second predetermined phase range including a 270-degree phase.

12. The phase control device according to claim 1, wherein at the beginning of a phase control operation, the timing setting portion sets the turn-on timing while raising the phase angle of the AC voltage stepwise every half-wave.

13. The phase control device according to claim 1, wherein at the end of a phase control operation, the timing setting portion sets the turn-off timing while lowering the phase angle of the AC voltage stepwise every half-wave.

14. An image forming apparatus comprising:

the phase control device according to claim 1;

a fusing device; and a heater that heats the fusing device, wherein the heater is the load in the phase control device, the load receiving power from the AC power source.

15. A non-transitory computer-readable recording medium storing a phase control program for a computer of a phase control device, the phase control device comprising at least one switching element connected to an AC power source, the switching element being capable of:

turning on and off at specified timings;

delivering power to a load from the AC power source upon turn-on and breaking power supply to the load upon turn-off; and keeping an on-time from the start to the end of turn-on and an off-time from the start to the end of turn-off, the on-time and off-time being variable;

the phase control program allowing the computer of the phase control device to execute:

setting a turn-on timing for turning on the switching element and a turn-off timing for turning off the switching element;

judging whether or not the turn-on and turn-off timing are on at a phase within a first phase range or a second phase range, the first phase range representing a 0-degree phase and approximate 0-degree phases of AC voltage input by the AC power source, the second phase range representing a 180-degree phase and approximate 180-degree phases of AC voltage input by the AC power source; and starting turning on and off the switching element at the turn-on and turn-off timing set by the timing setting portion and adjusting the on-time and off-time for the switching element depending on the judgment result obtained, wherein, if the turn-on and turn-off timing are on at a phase within the first phase range or the second phase range, the on-time and off-time is made shorter than those obtained if the turn-on and turn-off timing are on at a phase not within the first phase range or the second phase range.

* * * * *